US008893411B2

(12) United States Patent
Cocksedge

(10) Patent No.: US 8,893,411 B2
(45) Date of Patent: Nov. 25, 2014

(54) IRONING BOARD

(75) Inventor: John Cocksedge, North Yorkshire (GB)

(73) Assignee: Vale Mill (Rochdale) Limited, Rochdale, Lancashire (GB)

( * ) Notice: Subject to any disclaimer, the term of this patent is extended or adjusted under 35 U.S.C. 154(b) by 0 days.

(21) Appl. No.: 13/496,695

(22) PCT Filed: Sep. 20, 2010

(86) PCT No.: PCT/GB2010/001756

§ 371 (c)(1),
(2), (4) Date: Jun. 15, 2012

(87) PCT Pub. No.: WO2011/033269

PCT Pub. Date: Mar. 24, 2011

(65) Prior Publication Data

US 2012/0246983 A1 Oct. 4, 2012

(30) Foreign Application Priority Data

Sep. 18, 2009 (GB) ..... 0916384.1

(51) Int. Cl.
*D06F 81/04* (2006.01)
*D06F 81/10* (2006.01)
*A47B 9/16* (2006.01)

(52) U.S. Cl.
CPC ..... *D06F 81/04* (2013.01); *D06F 81/10* (2013.01)
USPC ..... 38/138; 108/116

(58) Field of Classification Search
USPC ..... 38/103–139; 108/115–133
See application file for complete search history.

(56) References Cited

U.S. PATENT DOCUMENTS

| | | | | | |
|---|---|---|---|---|---|
| 858,969 | A | | 7/1907 | French | |
| 1,352,361 | A | | 9/1920 | Everett | |
| 2,485,193 | A | * | 10/1949 | Foglio | 38/139 |
| 2,594,123 | A | | 4/1952 | Cater | |
| 2,683,944 | A | * | 7/1954 | Ripley | 108/117 |
| 2,721,407 | A | | 10/1955 | Sutherland | |
| 2,908,984 | A | * | 10/1959 | Lantz | 108/117 |
| 2,912,775 | A | | 11/1959 | Gettelman | |
| 2,950,442 | A | | 8/1960 | Stephany | |
| 2,974,431 | A | * | 3/1961 | Ribaudo | 108/117 |
| 3,206,881 | A | | 9/1965 | Kleinsorge | |

(Continued)

FOREIGN PATENT DOCUMENTS

| | | | |
|---|---|---|---|
| DE | 102004021314 | A1 | 11/2005 |
| EP | 0686722 | A1 | 12/1995 |

(Continued)

*Primary Examiner* — Ismael Izaguirre
(74) *Attorney, Agent, or Firm* — Barlow, Josephs & Holmes, Ltd.

(57) ABSTRACT

An ironing board (1) having a board member (3) connected to a support structure (5). The ironing board (1) also has a base (7) for supporting the ironing board (1) on a surface and adjustment means (9) which permits the position of the support structure (5) relative to the base (7) to be adjusted to enable the height of the board member (3) to be adjusted relative to the surface. The base (7) may have a first leg (42) formed by a pair of substantially parallel elongate tubes (40) and a second leg (46) formed by a single elongate member (46) which is pivotally connected to the adjustment means (9). The board member (3) may be made from two sections (11, 13) that are pivotally connected to one another to permit the board member (3) to be folded.

12 Claims, 21 Drawing Sheets

(56) References Cited

U.S. PATENT DOCUMENTS

| | | | | | |
|---|---|---|---|---|---|
| 3,288,090 | A | * | 11/1966 | King | 108/138 |
| 3,698,110 | A | * | 10/1972 | Shettel | 38/107 |
| 4,956,929 | A | * | 9/1990 | Chirabandalsuk | 38/136 |
| 4,991,325 | A | | 2/1991 | Teduschi | |
| 5,272,825 | A | * | 12/1993 | Simpson | 38/137 |
| 5,924,226 | A | * | 7/1999 | Zuber | 38/137 |
| 7,685,750 | B2 | * | 3/2010 | Voitchovsky | 38/103 |
| 2003/0121186 | A1 | | 7/2003 | Gross et al. | |
| 2006/0117614 | A1 | | 6/2006 | Lee et al. | |
| 2007/0044350 | A1 | | 3/2007 | Tang | |

FOREIGN PATENT DOCUMENTS

| | | | |
|---|---|---|---|
| EP | 0712955 | A2 | 5/1996 |
| EP | 1690977 | A2 | 8/2006 |
| EP | 1783267 | A1 | 5/2007 |
| FR | 1333922 | A | 8/1963 |
| WO | 02072941 | A1 | 9/2002 |
| WO | 2006080039 | A1 | 8/2006 |
| WO | 2007004122 | A2 | 1/2007 |
| WO | 2007004126 | A1 | 1/2007 |
| WO | 2011033269 | A1 | 3/2011 |

* cited by examiner

IRONING BOARD

The present invention relates to an ironing board.

Conventional ironing boards typically comprise a one piece board, tapered at one end, to which is attached a pair of collapsible legs that permit the ironing board to be converted from a collapsed state, suitable for storage, to a deployed state, suitable for ironing. The two legs are pivotally attached to one another about half way down their respective lengths. An end of one leg is pivotally mounted to the underside of the board towards one end of the board. An end of the other leg is slidably and pivotally mounted towards the opposite end of the underside of the board so that the mounting point can slide from the opposite end of the board towards the point to which the other leg is mounted. Means are provided to lock the sliding pivot in selected positions along the board. The sliding mount enables the legs of the board to be folded together and towards the board to facilitate storage of the board and, when the board is in use, the height of the board to be adjusted. However, a problem with such conventional ironing boards is that, in the collapsed state, the length of space required to store the ironing board is dependent upon the length of the board itself.

To address this problem ironing boards have been proposed which comprise a foldable board that can be reduced to a fraction of its total length. It is then necessary to provide legs for the board which can also be folded to a comparable size to the folded board, as well as allowing for the height of the board to be adjusted in use.

EP1783267A1 discloses an ironing board formed from two pivotally connected parts enabling its length to be reduced by about half. Two legs are pivotally mounted to one part of the board. Each leg comprises two parallel tubes connected to a cross-member, forming a foot, at the ends remote from the board. So that the length of each leg can be reduced to approximately the length of one part of the folding board, and to provide height adjustment each tube is formed from two telescopic members which may be locked relative to each other in a number of positions by way of spring loaded pins. Each tubular member has a spring loaded pin, so there are four in all. To adjust the length of the legs to deploy, collapse and adjust the height of the board involves releasing all four pins, and adjusting all four tubular members to the same length. This is time consuming and can be difficult for one person to carry out on their own in particular because it is either necessary to invert the board, or to stoop down in order to reach the legs.

An object of embodiments, of the invention is to mitigate difficulties in deployment.

According to an aspect of the present invention, there is provided an ironing board comprising a board member connected to a support structure, the ironing board further comprising a base for supporting the ironing board on a surface and adjustment means which permits the position of the support structure relative to the base to be adjusted to enable the height of the board member to be adjusted relative to the surface.

Advantageously, an ironing board according to the present invention can have a single point of release for height adjustment disposed between the support structure and base. The support structure and base can be independently collapsible making it easier for them to be collapsed into a length less than that of the board, making the arrangement suitable for use with foldable boards.

The adjustment means may comprise a moveable connection, for example a slidable connection, between the support means and the base. The adjustment means may comprise an engagement means to lock the position of the support structure relative to the base.

The board member may be attached to the support structure. The board member may be pivotally attached to the support structure. The board member may comprise more than one section. Two or more sections of the board may be pivotably and/or slidably connected. Each section may be arranged such that one section can overlie the other. The board member may be foldable.

The base may be collapsible. The base may be free standing. The base may comprise a first leg and a second leg. The two legs may be pivoted relative to one another. One or both legs may be connected to the adjustment means. One or both legs may be pivotally connected to the adjustment means.

The support structure may comprise a part of a leg of the board, the other part of the leg forming part of the base.

Accordingly, another aspect of the present invention provides an ironing board comprising a board member, a first leg pivotally connected to the board member, the first leg having an adjustable length, a strut for attachment between the first leg and the board member thereby to support the board member and a second leg for attachment to the first leg.

The board may comprise two or more foldable board sections. The first leg may comprise two or more adjustable connected members. The members may be slidably connected and/or may be telescopic. A releasable locking means may be provided to lock the two members together. The strut may be pivotally connected to the leg. The strut may also be pivotally and slidably connected to the board member. The second leg may be pivotally connected to the first member.

According to another aspect of the present invention there is provided an ironing board comprising a board member having an at least partially hollow thickness, a support which is slidably connected to the board member and a releasable latch means for retaining the support relative to the board member, wherein the latch means comprises a release handle disposed substantially wholly within the thickness of the board.

Locating the release handle within the thickness of the board helps to reduce the volume of space required to store the ironing board, particularly when in a folded state. Whilst the saving in space might be small as compared to boards with conventional release handles it can still be commercially significant when multiple boards are being shipped, for example from a manufacturer to retailer, as the overall shipping volume is reduced for a given number of boards.

The release handle may be moveable between two operative positions. If so, the release handle may remain within the thickness of the board throughout its range of movement between the two positions. The board member may provide a substantially flat ironing surface and the release handle may be moveable in a plane substantially parallel to the ironing surface.

The release handle may move substantially only in a plane substantially parallel to the ironing surface. The release handle may pivot about an axis which is substantially perpendicular to the ironing surface. Pivoting movement may be provided by flexing of part of the handle. The release handle may be arranged to move in a direction towards an adjacent edge of the board to release the support member. The release handle is preferably disposed towards an edge of the board so that it is operable by a hand, whilst gripping the board. The release handle may be disposed towards one end of the board member, for example about three quarters along the length of the board member.

Such a release handle is accessible to a user whilst in an upright stance and is convenient to operate whilst gripping the board, for example when collapsing the board.

The release handle may be resiliently biased. Two, opposed release handles may be provided at opposite sides of the board. One or both handles may be moveable. One may be fixed.

The latch means may enable the support to be retained relative to the board member in a number of different relative positions.

According to another aspect of the present invention there is provided an ironing board comprising a board member, and a support structure for supporting the board member over a surface, the support structure having a footprint, wherein the support structure enables the height at which the board member is supported over a base to be adjusted and maintaining a substantially constant footprint throughout a range of different board heights.

The support structure may comprise two or more legs.

In order that the invention may be more clearly understood an embodiments thereof will now be described, by way of example, with reference to the accompanying drawings of which:

Figure 1:
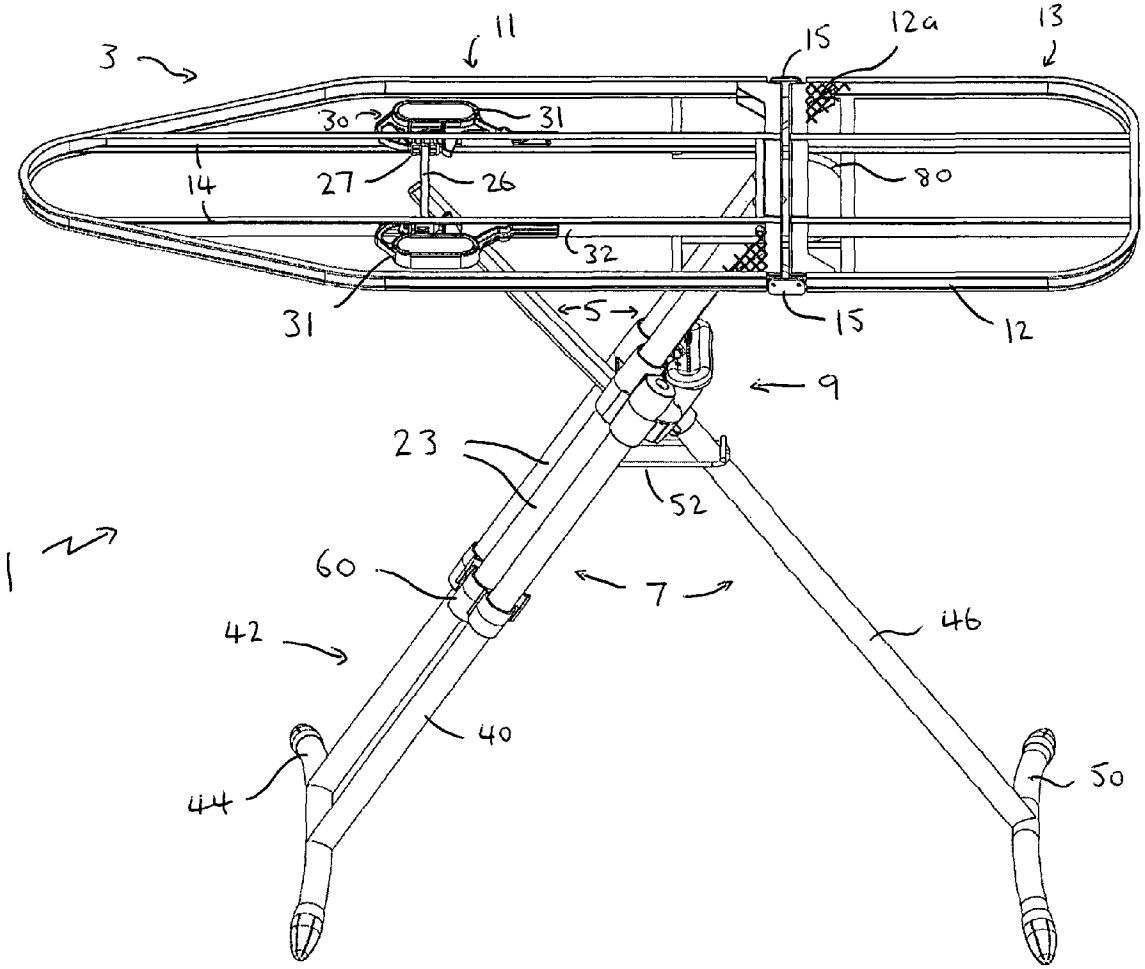
FIG. 1 is a perspective view of an ironing board according to the invention in a deployed state.

Referring to the drawings there is shown an ironing board 1 made from powder coated steel and plastics material components comprising a board member 3 which is supported by a support structure 5. The ironing board further comprises a free-standing base 7 for supporting the ironing board on a surface and an adjustment means 9. The adjustment means 9 permits the position of the support structure 5 relative to the base 7 to be adjusted to enable the height of the board member 3 to be adjusted relative to the surface.

Figure 2:
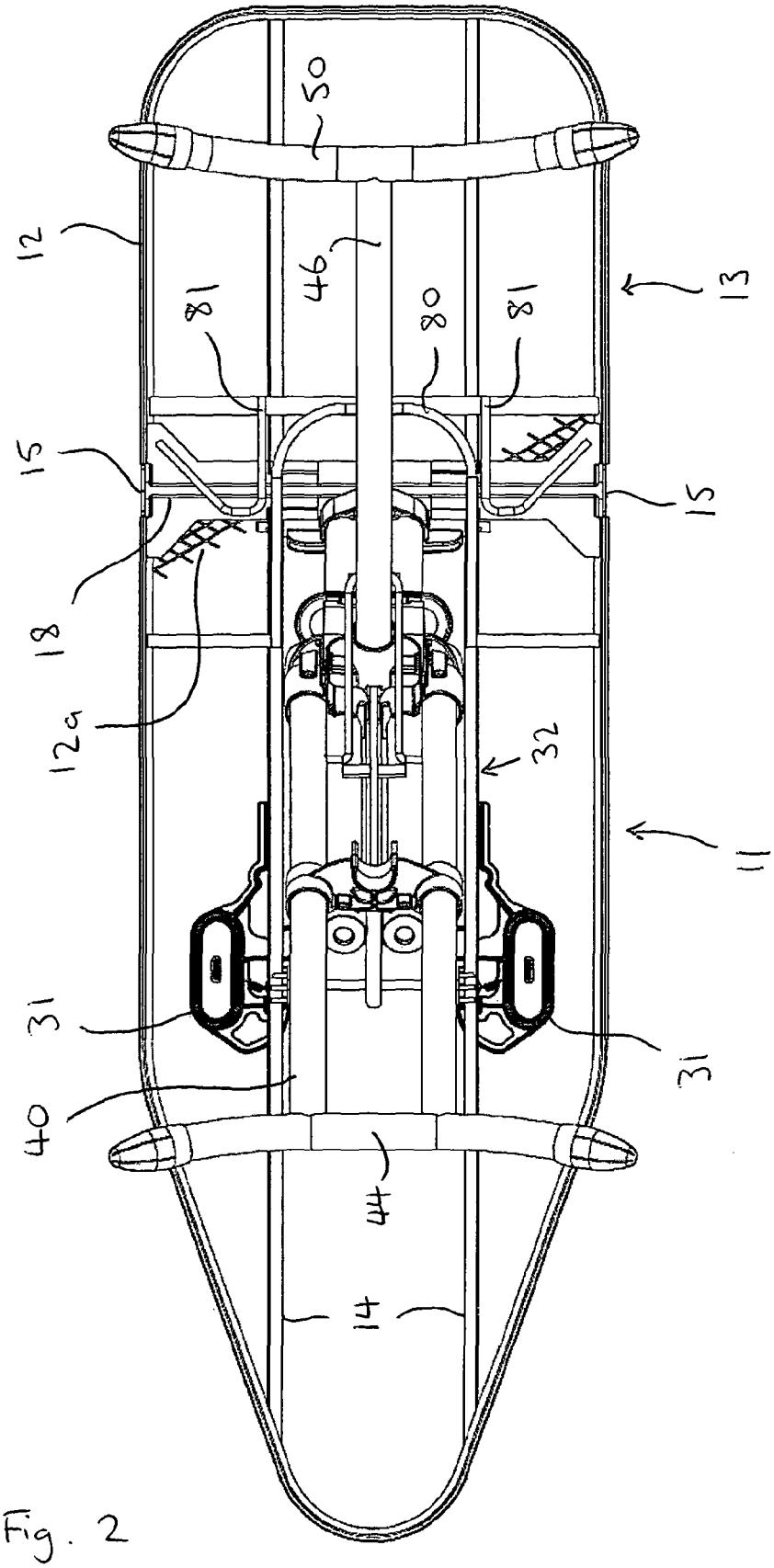
FIG. 2 is an underplan view of part of the ironing board shown in FIG. 1.
Figure 3:
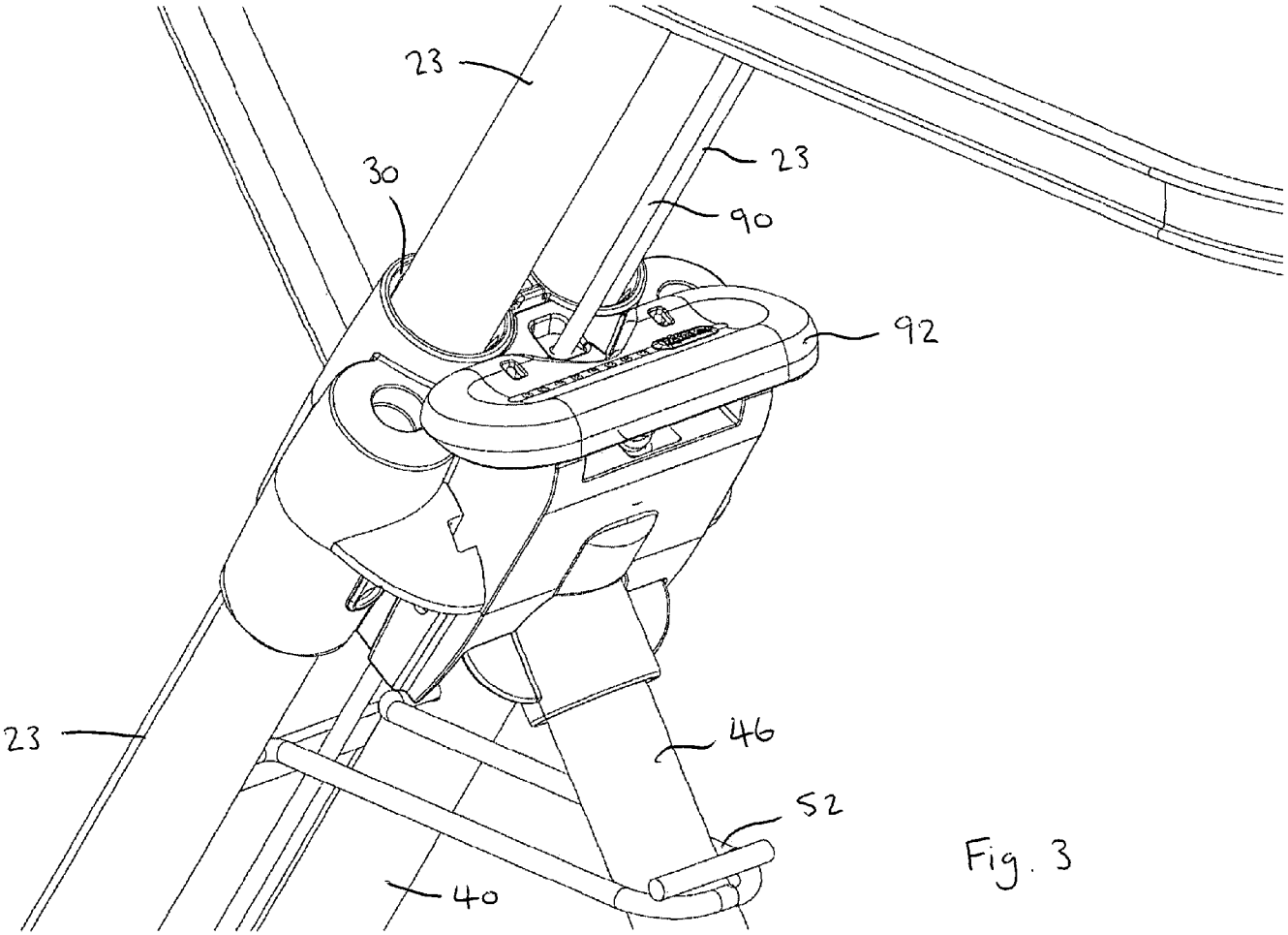
FIG. 3 is an enlarged perspective view of an adjustment means of the ironing board shown in FIG. 1.
Figure 4:
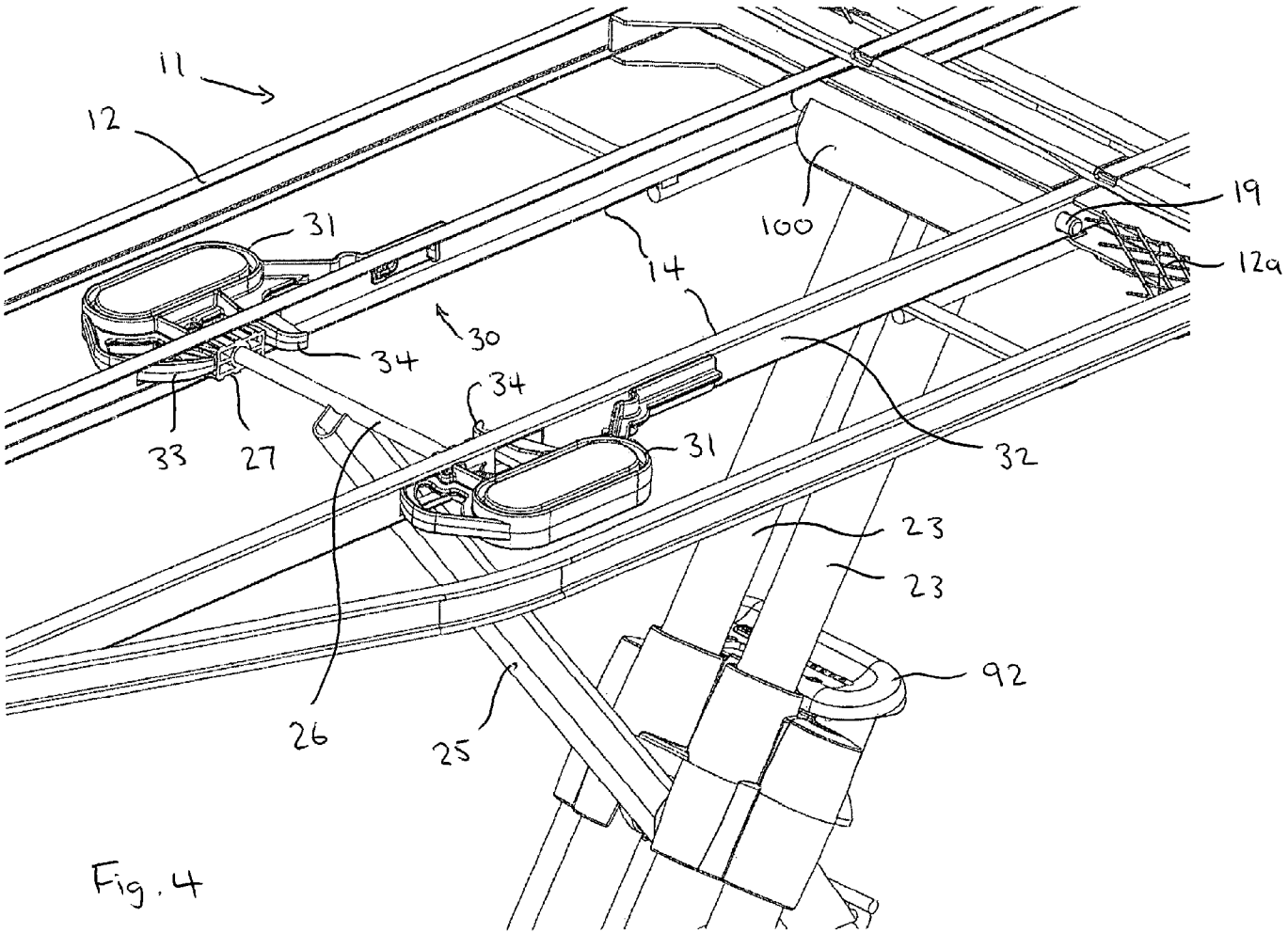
FIG. 4 is an enlarged perspective view of part of the top of the ironing board shown in FIG. 1.
Figure 5:
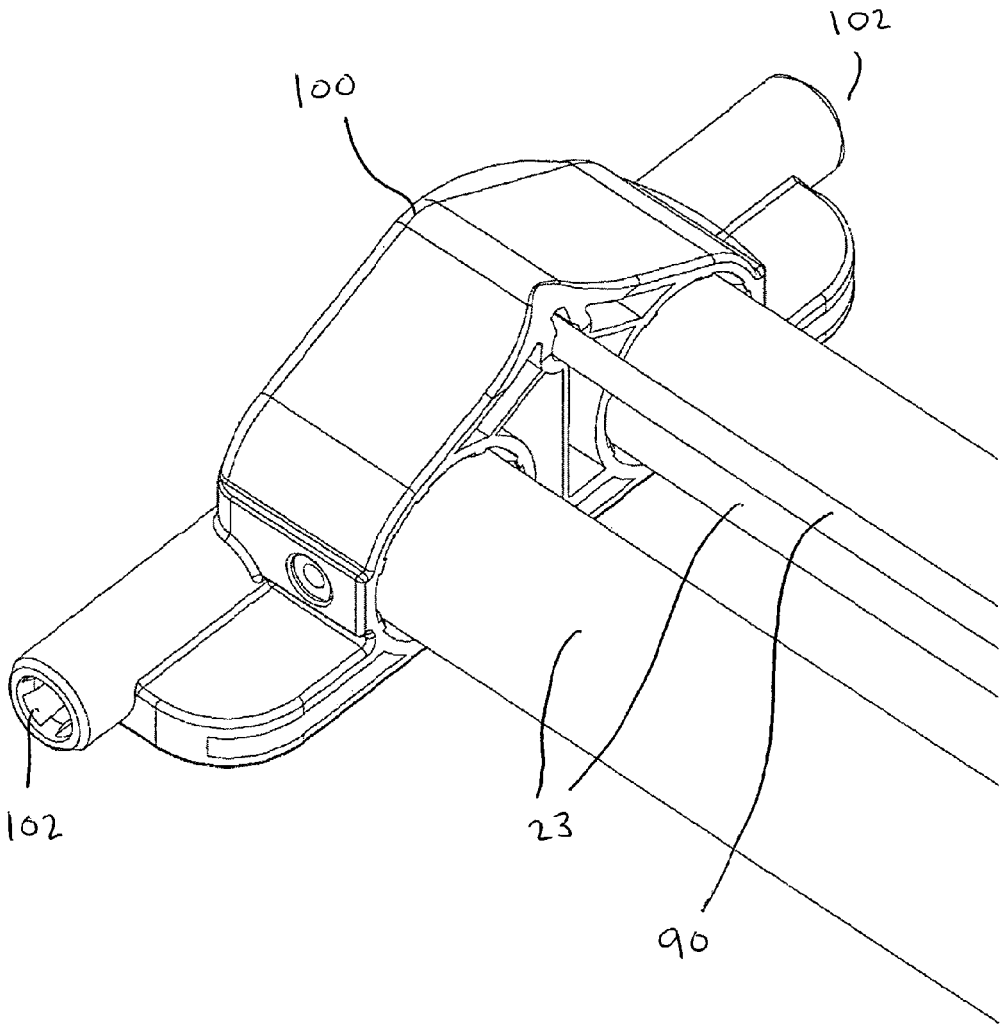
FIG. 5 is an enlarged perspective view of part of the support structure of the board shown in FIG. 1.
Figure 6:
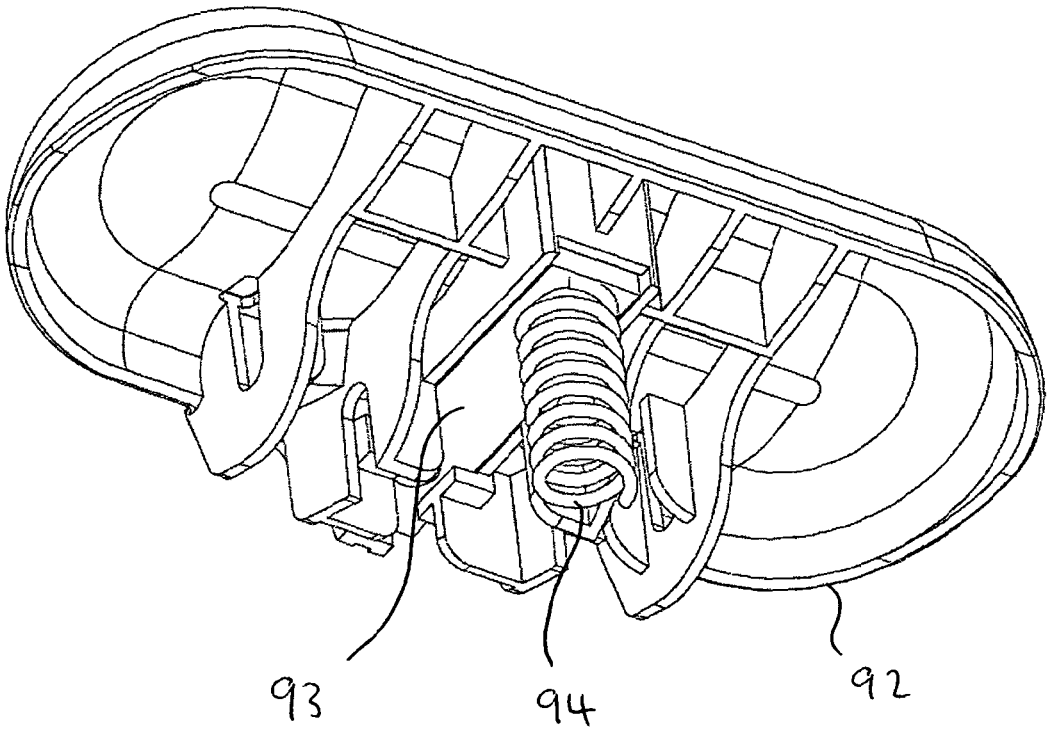
FIG. 6 is an enlarged perspective view of the engagement member of the board of FIG. 1.
Figure 7:
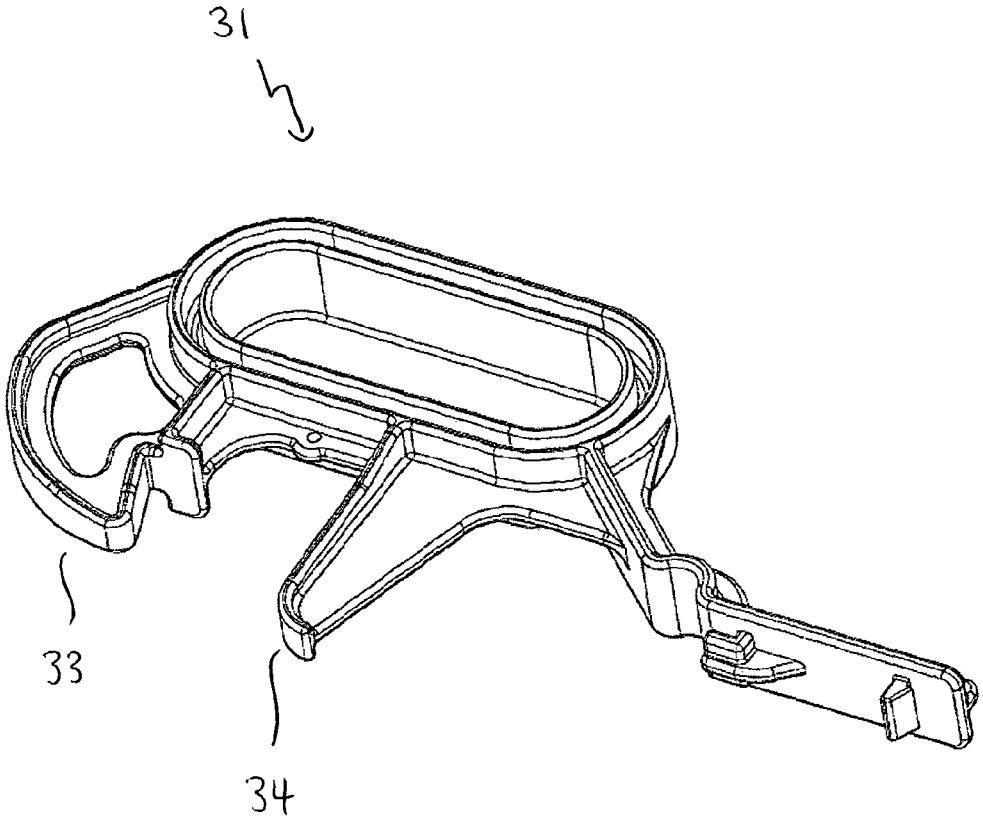
FIG. 7 is an enlarged perspective view of a release handle of the board of FIG. 1.

The board member 3 comprises two sections, a front section 11 and a rear section 13, which both comprise an outer frame 12 that supports a powder coated steel mesh surface 12*a* (partially shown in FIGS. 1, 2 and 4) upon which an ironing board cover (not shown) may be placed for ironing. Two additional substantially parallel, equally spaced apart frame elements 14 are provided on each section 11, 13 extending along their respective lengths to provide additional strength and support for the mesh surface. One section, referred to as the front section, 11 is longer than the other section, referred to as the rear section 13. The front section is tapered at its free end in the conventional manner of an ironing board. Other board shapes are, however, possible.

The two board sections 11, 13 are pivotally connected to one another by way of two steel links 15, to which each board is pivotally connected. The links are located in recesses 17 provided in sides of adjacent ends of the two board sections 11, 13. A rod 18 is inserted through the respective recesses 17 of each board section and through apertures in each link 15, such that both sections 11, 13 can pivot about the link 15 and be moved relative to one another. The links 15 enable the two board sections to be moved from a collapsed state in which the two sections over lie each other (for storage of the board) and a deployed state in which the two sections are substantially coplanar (for use of the board).

A board support 80 comprising a U-shaped metal tube is welded to the underside of the inner frame elements 14 of the front section 11 and extends beyond that section so as to underlie and support the rear section 13 of the board in the deployed state. Further board supports 81 also formed by metal tubing are welded to the underside of elements of the frame of the rear section 13 and extend beyond that section so as to underlie the front section 11 of the board in the deployed state and therefore provide further support for the rear section 13. Of course, other embodiments are possible where the various supports have different shapes or forms.

The support structure comprises two elongate, substantially parallel, powder coated steel tubes 23. At one end, the upper end when the ironing board is in the deployed state as shown in the drawings, the tubes 23 are received into a first plastic moulding 100. The moulding 100 defines two spaced apart substantially circular bores into which the tubes 23 are received with a close fit, and secured by any suitable means, such as a spring pin. To the top of the plastics moulding 100 are defined two further opposed bores 102 extending in a substantially perpendicular direction to those receiving the tubes 23. The bores 102 each receive a respective steel half shaft 19 which are introduced into the bores through respective apertures in the inner frame member 14 of the front section 11 of the board member and secured into the apertures by spring pins, thereby to pivotally secure the first plastic moulding 100 to the board member 11.

In an alternative embodiment, the two tubes 23 are welded to a metal plate which replaces the first plastic moulding, and a rod is welded to the plate to replace the half shafts.

At the opposite end to the first plastic moulding, the tubes 23 are received into two bores defined by a second plastics moulding 60, the two bores being spaced apart by the same amount as those of the first plastic moulding. A powder coated steel rod 90 extends from a further bore defined in the first plastic moulding 100 to a bore defined by the second plastic moulding 60, so that it extends generally between the two tubes 23.

A powder coated steel strut 25 is pivotally mounted relative to the two tubes 23, between the members so that the strut 25 moves with the tube 23. A rod 26 extends perpendicularly from the inner frame elements 14 towards the end of the strut 25 remote from the tubes.

The two tubes 23 each extend through respective open ended cylinders 38 defined by a third plastics moulding 9, forming an adjustment means, so that the tubes 23 can slide relative to the third plastics moulding 9. Mounted to the third plastics moulding 9 is a pivotally mounted engagement member 92. The engagement member comprises a plastics moulding forming a handle and housing of hardened steel, or other suitable material, chock plate 93 and a helical spring 94. The engagement member is pivotally mounted to the third plastics moulding 9 such that chock plate 93 is urged into frictional engagement with the rod 90 by the helical spring 94, thereby to prevent the tubes 23 sliding through the open ended cylinders 38 unless the engagement member is released by pivoting it against the resilient bias.

Variations are of course possible to the engagement means. Other arrangements are possible to selectively prevent and permit relative movement between the tubes 23 and the third plastics moulding 9. For example, with the described arrangement, where the rod 90 is supported at both its ends, it is important that the two tubes 23 and rod 90 are parallel to a sufficient tolerance that they can move freely through the third plastics moulding 9 when the engagement means is released. This requirement can be reduced in an alternative arrangement where the rod 90 is only mounted at one of its ends.

The front section 11 of the board member 3 is supported by the support structure via the half shafts 19 fitted into the first plastics moulding 100 described above, so that the front section of the board can pivot relative to the first plastics moulding 9 and tubes 23. Opposite ends of the rod 26 which extends from the strut 25 are each received into respective moulded plastics sliding members 27 which are slidably mounted into respective channels defined by the two inner frame elements 14 of the front section 11 of the board member. The two sliding members 27 may each be locked in a selected position relative to the first section 11 of the board member by respective latch mechanisms 30.

Each latch mechanism 30 comprises a plastics release handle 31 that is fixed at one end to the outer face 32 of the inner frame element 14. The handle 31 is formed from a resiliently flexible plastics material and inherently resiliently biased such that its free end is urged toward the frame element 14, but can be flexed and moved away from the frame element 14. The free end of the handle comprises a generally wedge shaped edge 33 that extends through a corresponding aperture in the frame element 14 so that it protrudes in to the channel defined by the frame element in which the sliding member 27 moves. The wedge shaped edge of the handle 31 permits the sliding element to pass when moving from the free, tapered, end of the first section of the board member to the other, but prevents it passing in the reverse direction unless the handle is urged away toward the outer edge of the section withdrawing the wedge shaped edge through the aperture in the frame element 14. The handle 31 also comprises a stop formation 34 which prevents movement of the sliding members beyond the stop, regardless of the position of the handle.

The free standing base 7 comprises a first leg 42 formed by a pair of substantially parallel elongate tubes 40 connected to a common foot 44. These are received into the plastics moulding 9 forming the adjustment means, and extend with a close sliding fit through formations defined by the third plastics moulding 60 so that when the engagement member 92 is released the tubes 23 of the support structure can slide relative to the tubes 40 of the legs. A second leg is formed by a single elongate member 46, connected to a single foot 50. This leg 46 is pivotally connected to the third plastics moulding 9. A retainer 52 is pivotally mounted to the pair of legs 40 and extends around the second leg 46 to limit the angular separation of the first and second legs so that the legs can easily be opened to provide a stable base for the ironing board. The illustrated retainer is U-shaped. Other shapes are possible.

Figure 8:
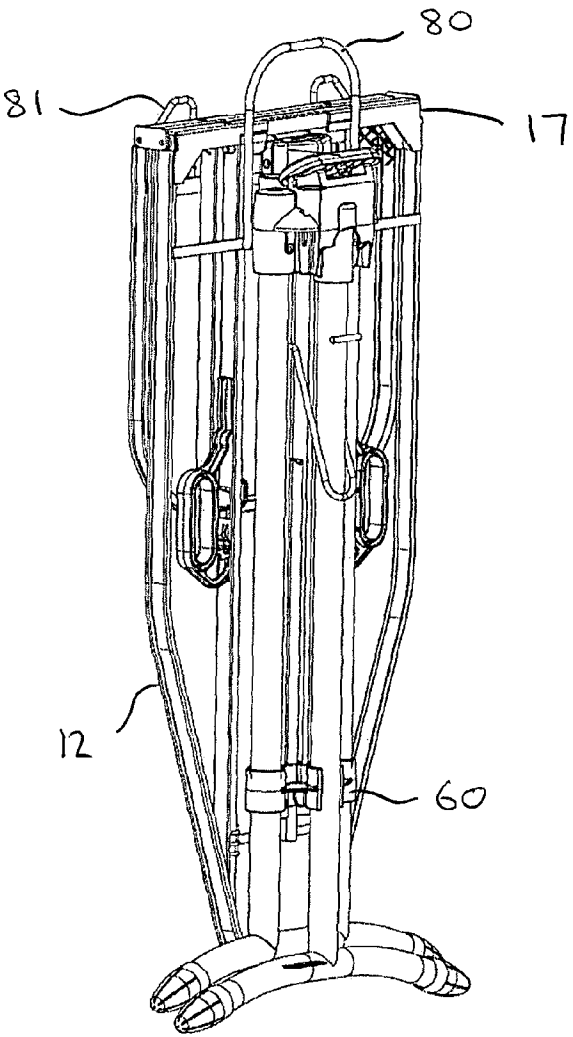
FIGS. 8 to 12 show various views of the board of FIG. 1 from a fully collapsed state to a fully deployed state.
Figure 9:
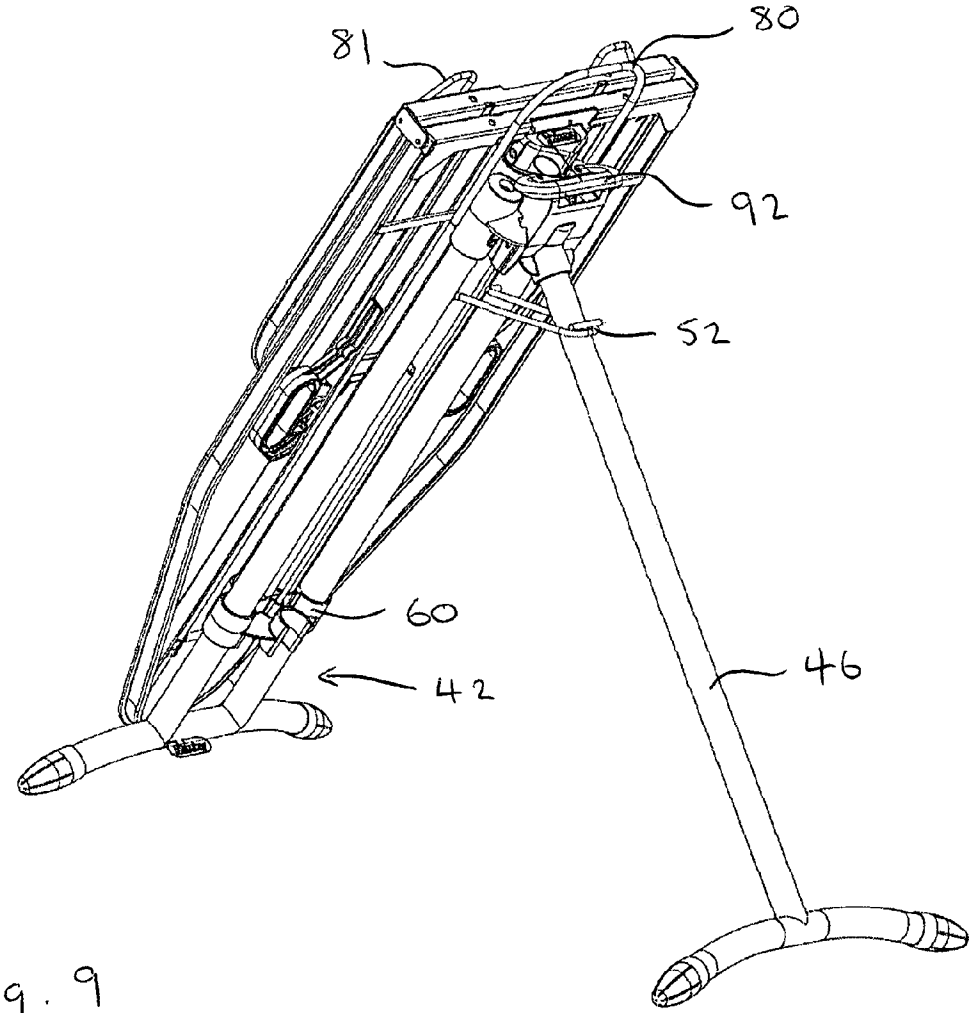
Figure 10:
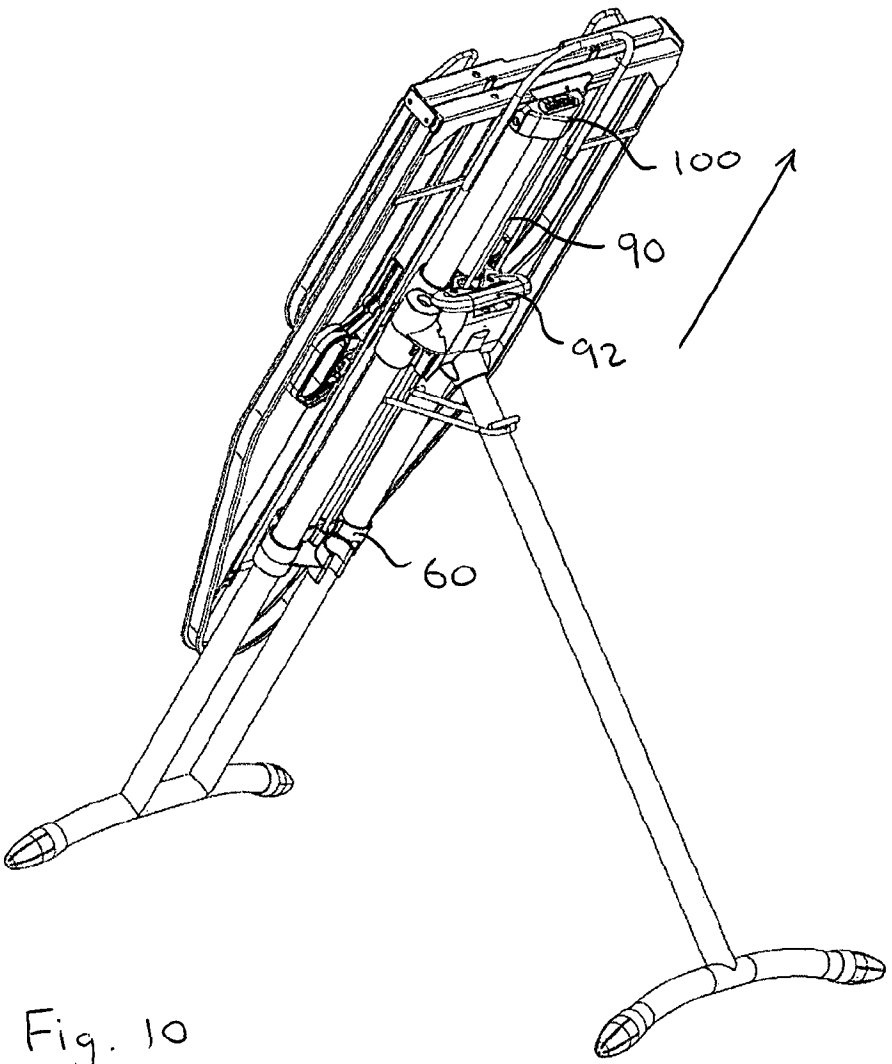
Figure 11:
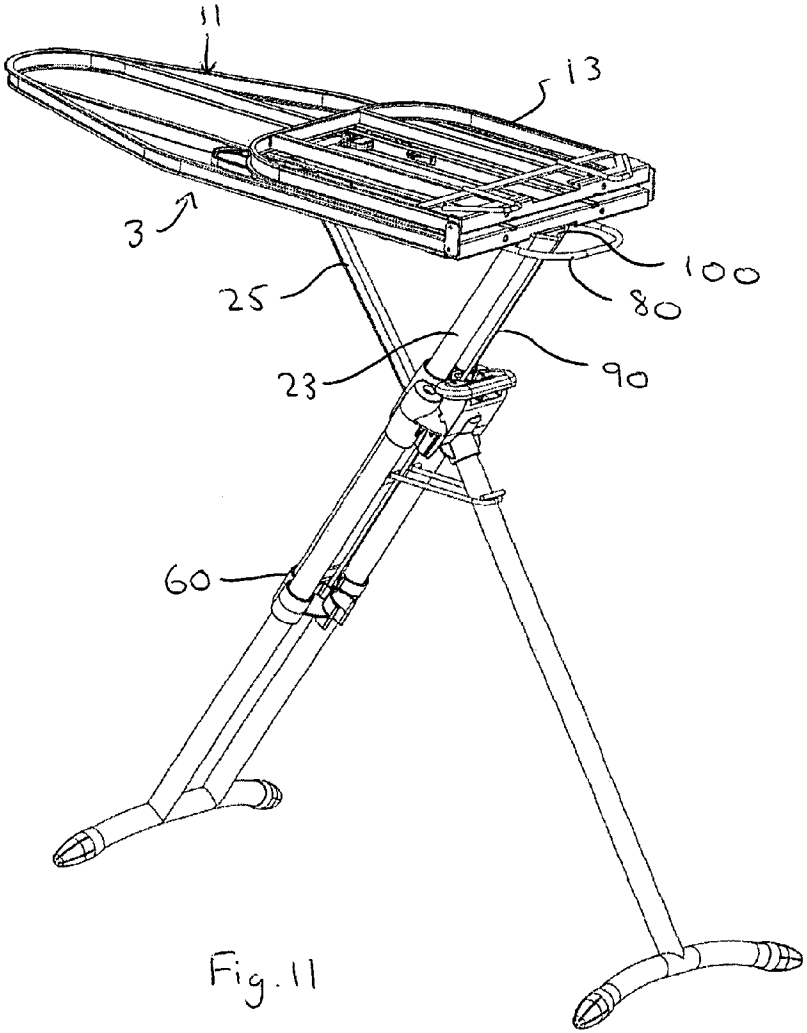
Figure 12:
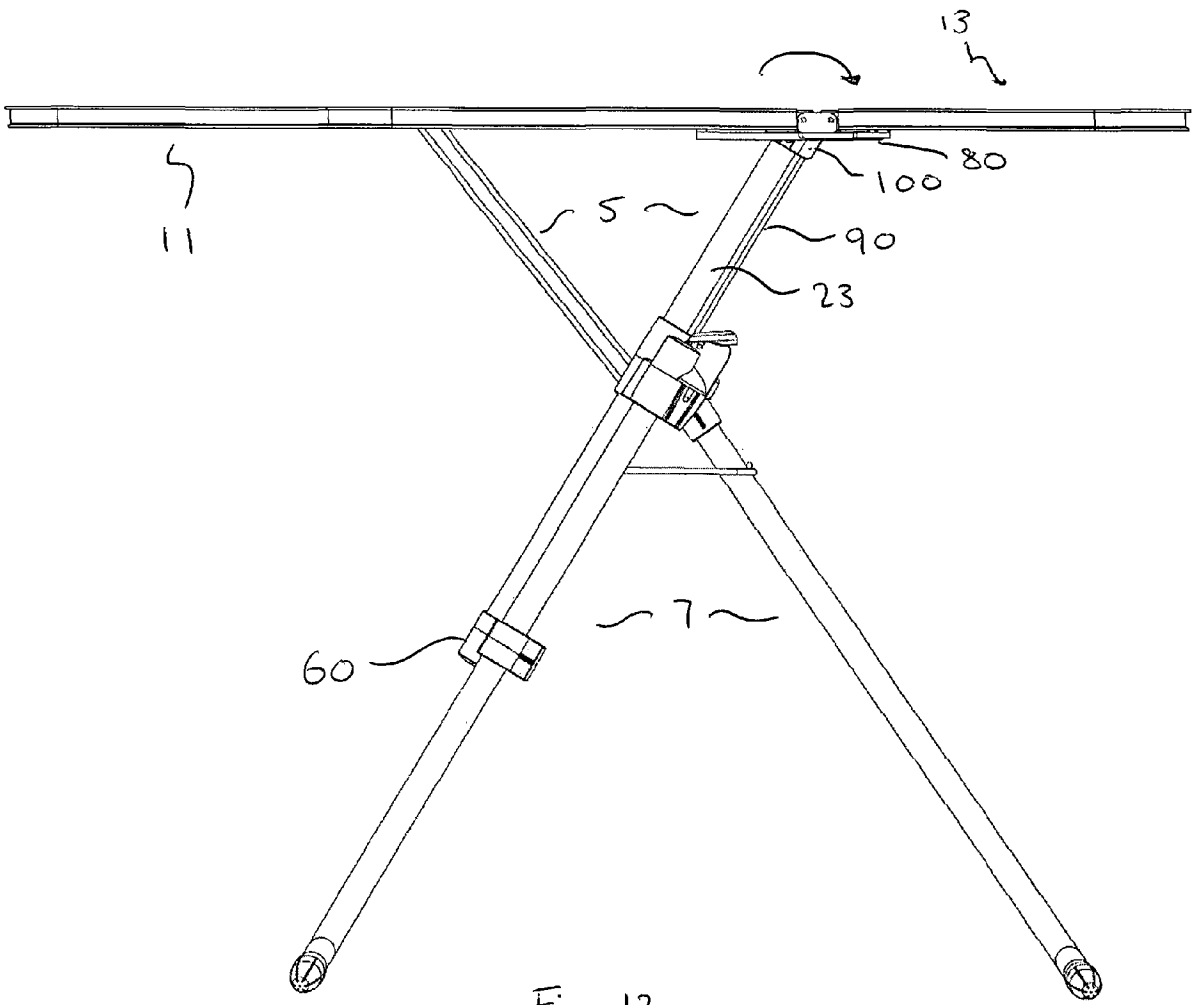
Figure 13:
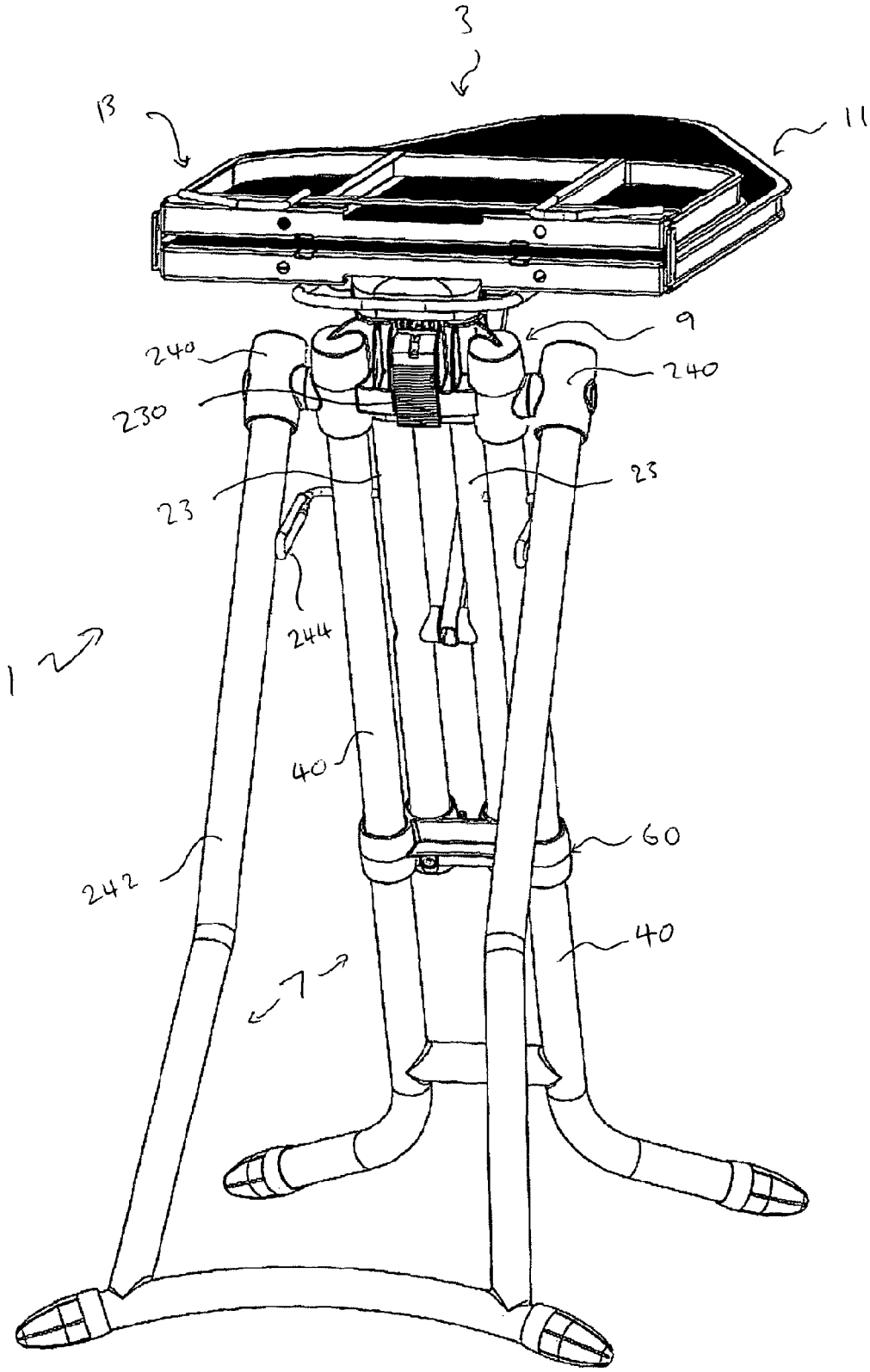
FIG. 13 is another embodiment of an ironing board according to the invention in a partially deployed state.
Figure 14:
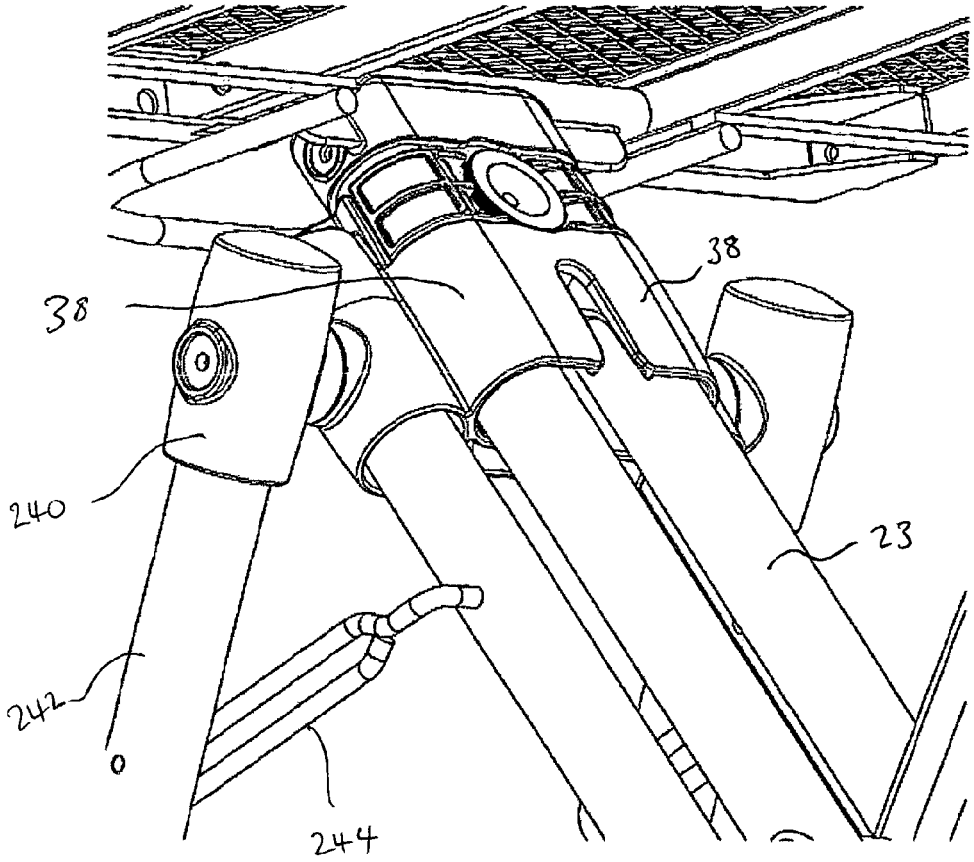
FIG. 14 is an enlarged perspective view of an adjustment means of the ironing board shown in FIG. 13.
Figure 15:
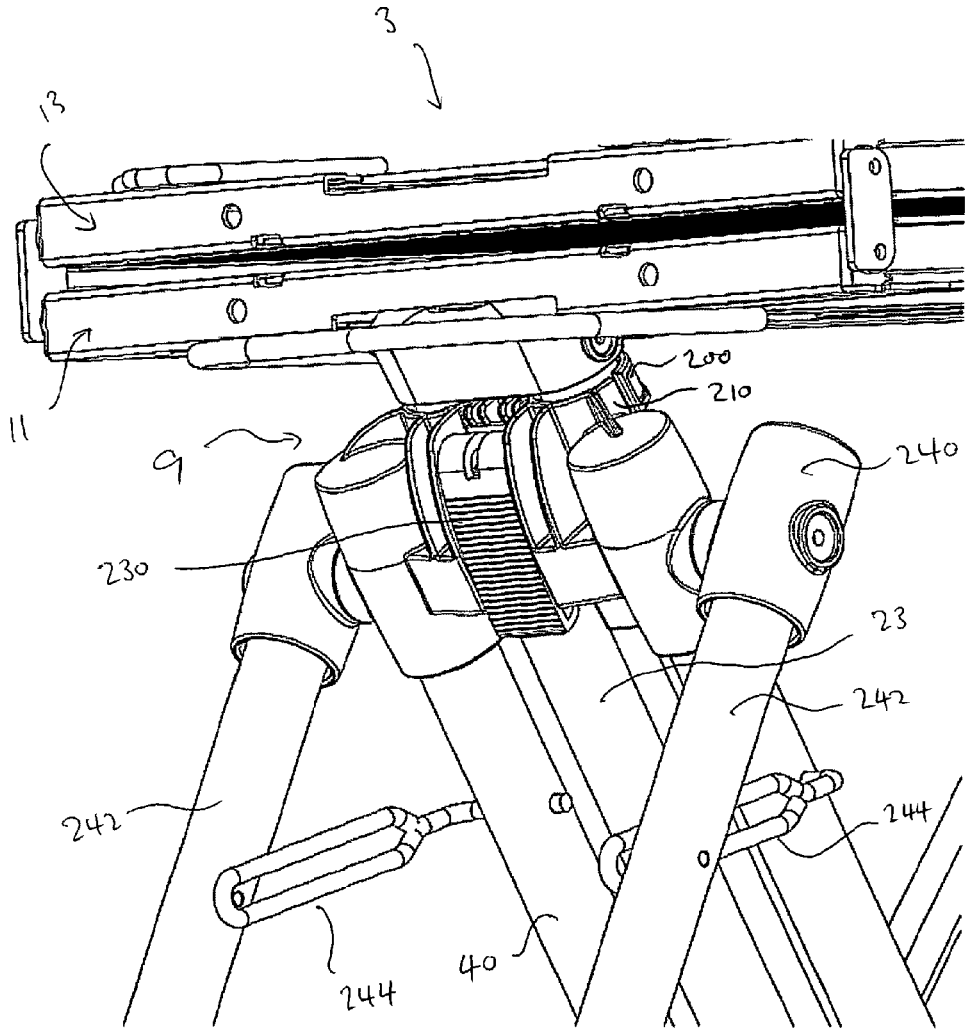
FIG. 15 is an enlarged perspective view of the adjustment means shown in FIG. 14 from a different angle when the adjustment means is in a locked state.
Figure 16:
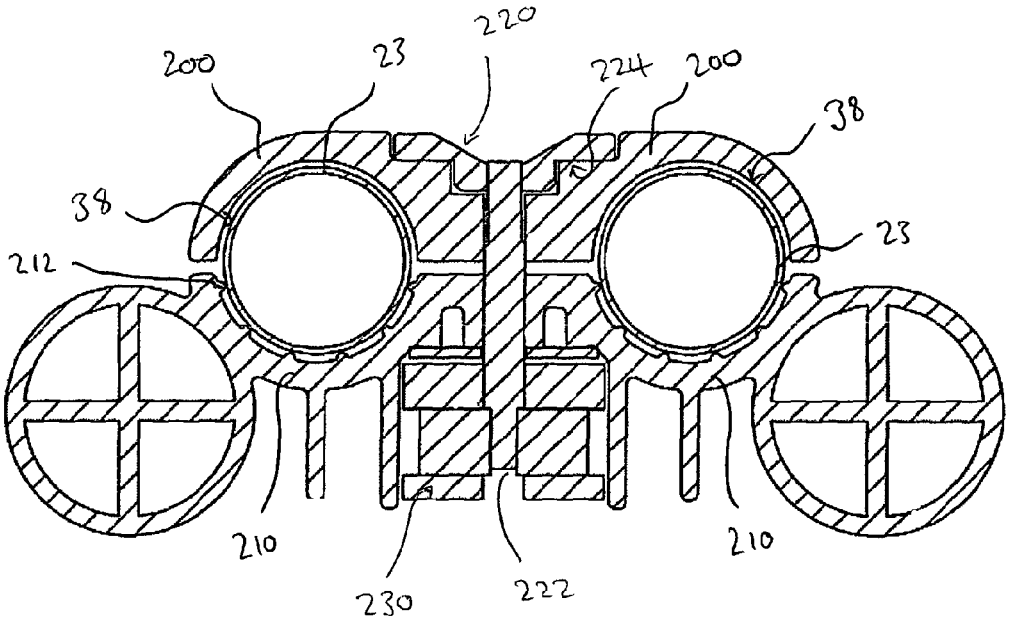
FIG. 16 is a cross sectional plan view of the adjustment means shown in FIG. 14 when in a locked state.
Figure 17:
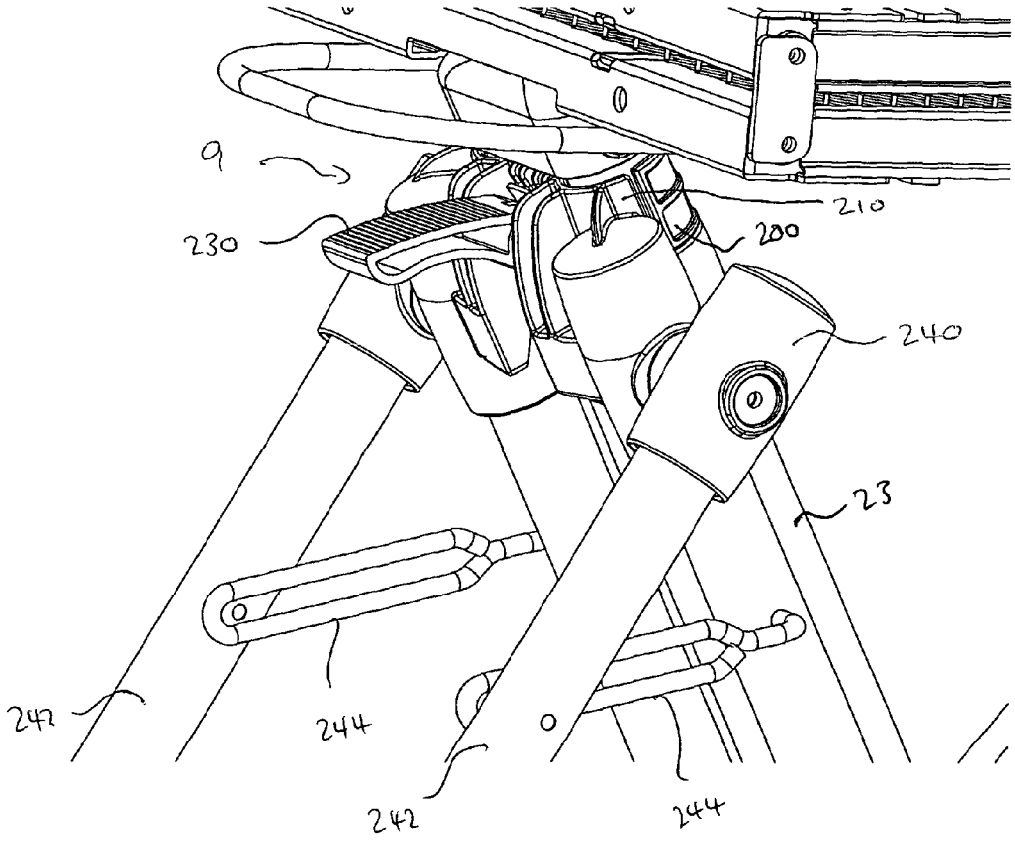
FIG. 17 is an enlarged perspective view of the adjustment means shown in FIG. 15 when in an unlocked state.
Figure 18:
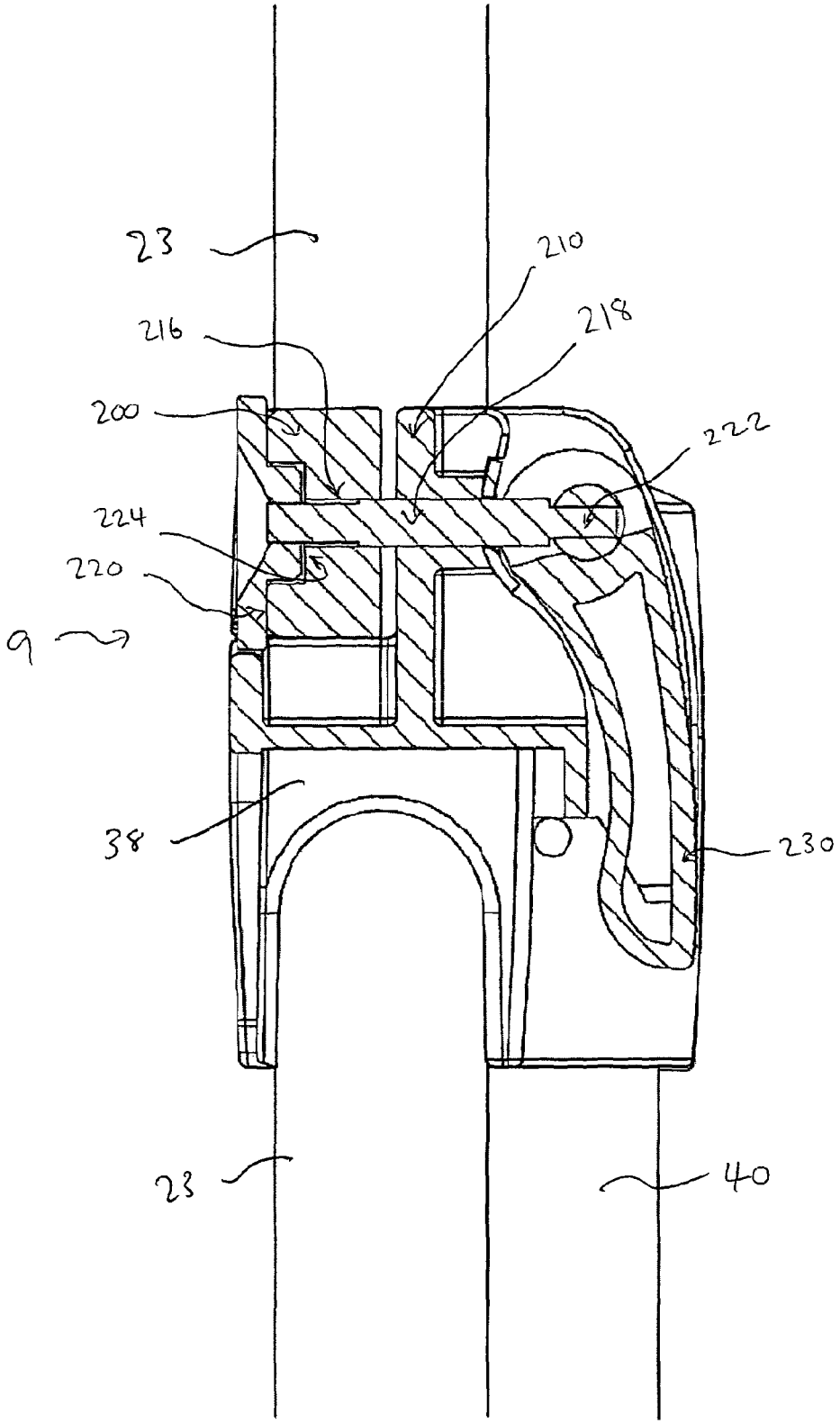
FIG. 18 is a cross sectional side view of the adjustment means shown in FIG. 14 when in a locked state.
Figure 19:
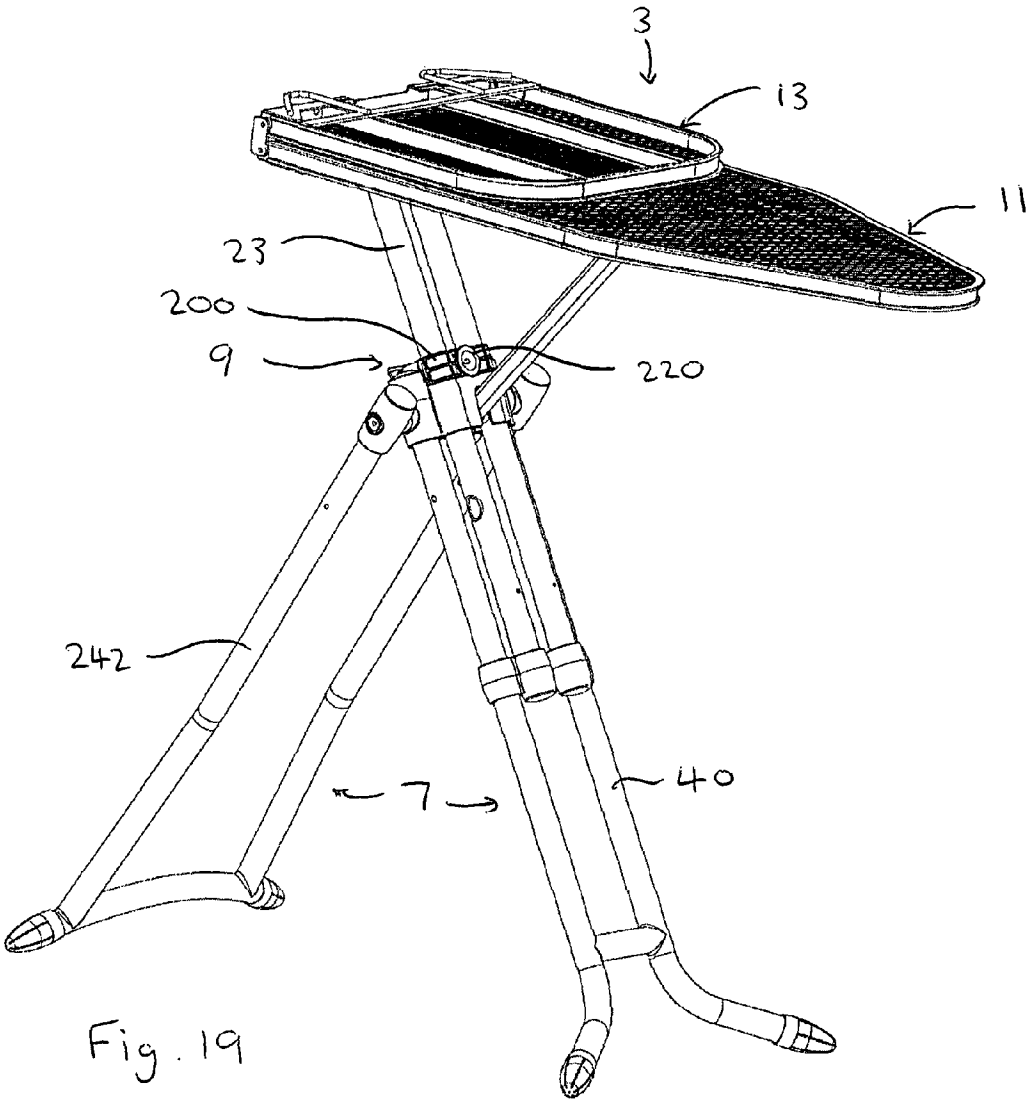
FIG. 19 is a perspective view of the ironing board shown in FIG. 13 in a more extended state and from a different angle.
Figure 20:
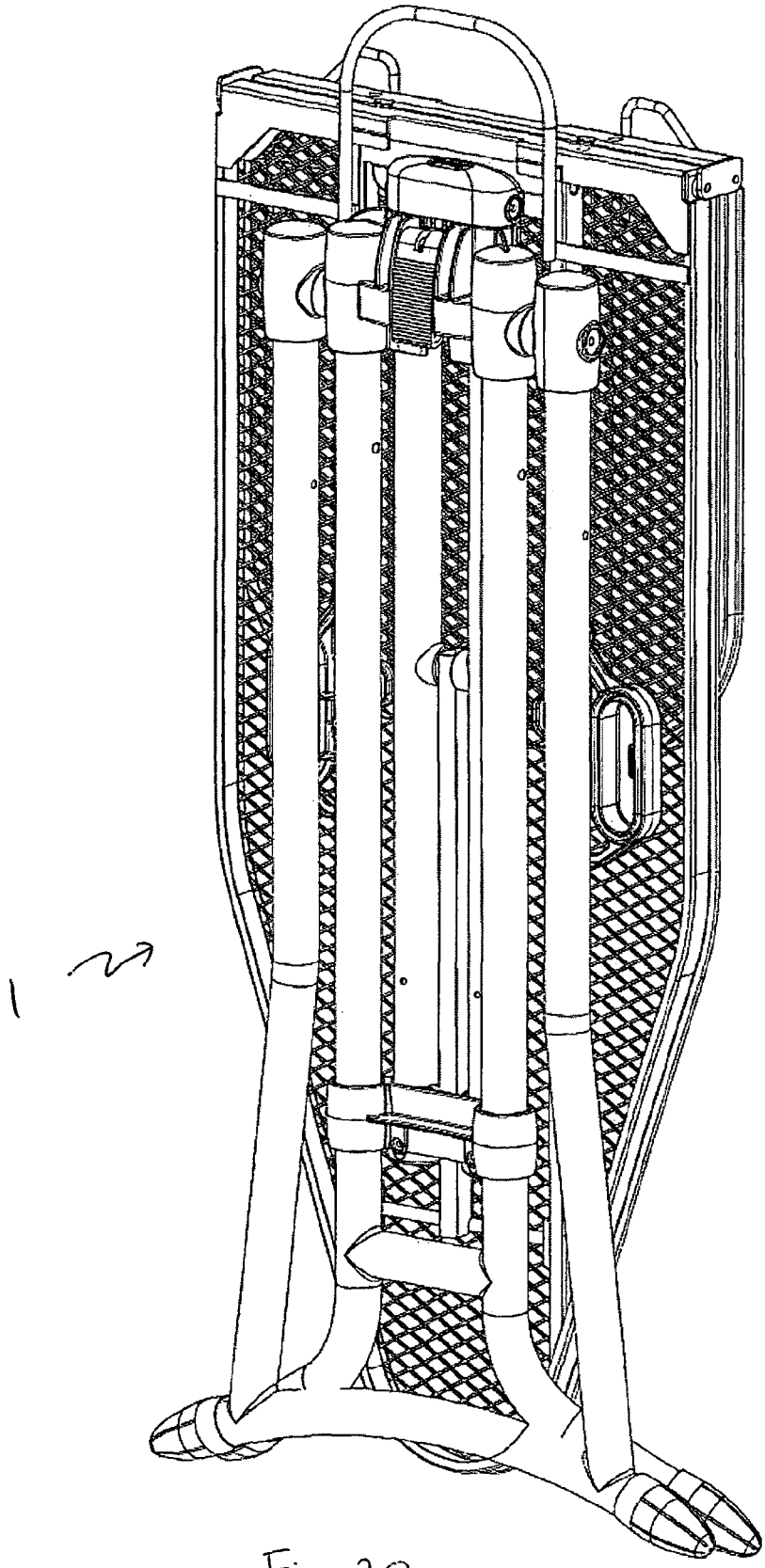
FIGS. 20 to 22 show various views of the ironing board shown in FIG. 13 in a collapsed state.
Figure 21:
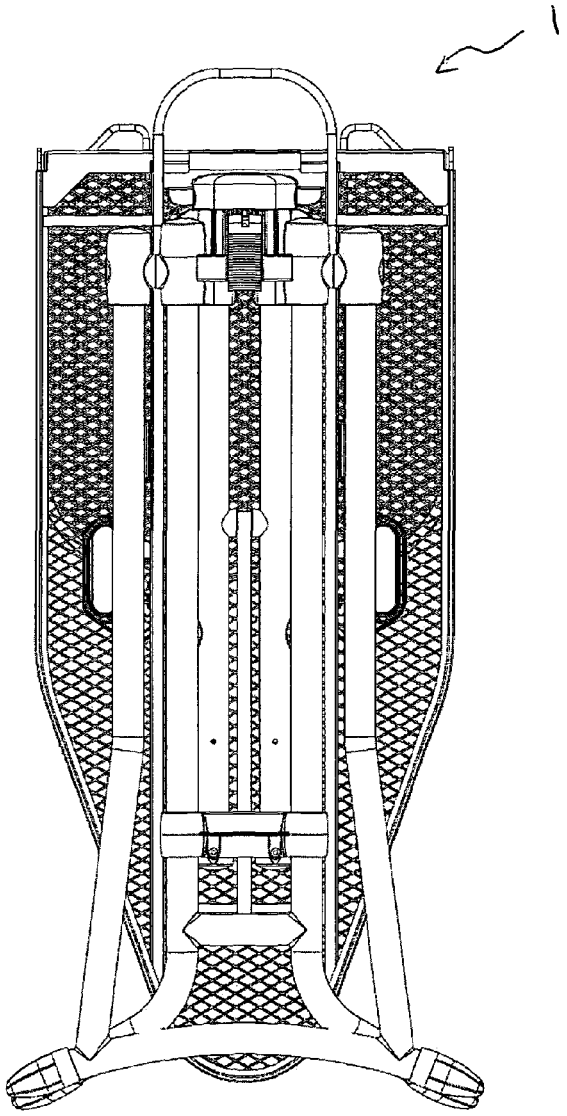
Figure 22:
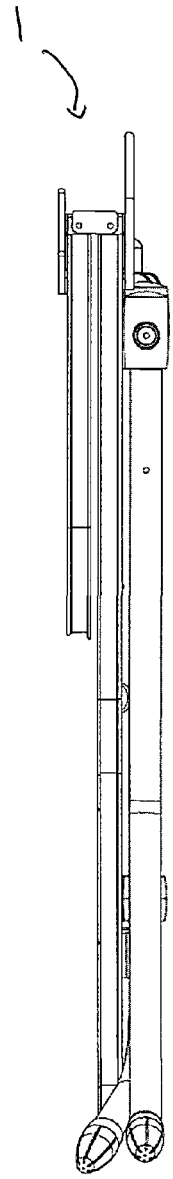

In use a fully collapsed ironing board 1 as shown in FIG. 8 is stood up on a supporting surface via its two legs 42, 46. The second leg 46 is pivoted away from the first leg 42 to the maximum extend permitted by the retainer 52 as shown in FIG. 9. The lever 92 of the adjustment means is then depressed and the support structure 5 is slid up through the adjustment means 9 to a desired height and the lever 92 is then released to lock the adjustment means against the spine 90 of the support structure 5. The ironing board is now in the state shown in FIG. 10. The folded board member 3 is then rotated upwardly away from the tubes 23 of the support structure 5 until the strut 25 becomes locked in place by the latch mechanism 30, with the sliders 27 passing the wedge shaped edges 33 of the handles 30, as shown in FIG. 11. At this stage the stop formations 34 of the handles 31 prevent the board member 3 being raised significantly above the intended working position, which is useful when the ironing board is being used. The rear section 13 of the board member 3 is then pivoted away from the front section 11 until it abuts the board support 80, the supports 81 abut the underside of the front section of the board 11, and the rear section 13 lies adjacent to and substantially coplanar with the front section 11. The height of the board above the surface can then be further adjusted if desired by varying the position of the support structure 5 relative to the base 3 via the adjustment means 9.

The ironing board 1 may be collapsed by reversing these steps, it being appreciated that the two handles 31 must be pulled away from each other to release the strut 25 and allow the board to fold down towards the support means. Release of the two handles is a two handed operation, but the handles can easily be operated whilst gripping opposite sides of the board section adjacent the handles, so that the board section can be lowered gently when the latches have been released.

Each of the steps involved in erecting and collapsing the ironing board can easily be carried out by one person, whilst standing. Adjustability of the height of the board can also easily be achieved by one person, and the board can be collapsed substantially into the length of the front section 11 of the board member.

Referring to FIGS. 13 to 22, in an alternative embodiment, the adjustment means 9, which is predominantly made from moulded plastics material, defines two open ended cylinders 38 through which extend the two tubes 23. An upper part 200 of the adjustment means 9 is detachably mounted to the rest of the body and held in place by a clamp bolt 218. The upper part 200 is made from die cast metal and serves as a clamp plate for retaining the tubes 23 relative to the adjustment means 9.

The clamp plate 200 and the adjacent section of the body 210 both define substantially semi-circular formations that extend in a direction substantially parallel to the tubes 23. The semi-circular formations are arranged on the clamp plate 200 and adjacent portion of the body 210 such that, when the clamp plate 200 is brought adjacent the body 210, the semi-circular formations on the clamp plate 200 face corresponding semi-circular formations on the body 210 to from cylinders thereby extending the overall length of the two cylinders 38. The semi-circular formations on the body 210 have small angular projections 212 that extend out from and along the surface of the semi-circular formations in a direction substantially parallel to the tubes 23.

A hole 216 is defined in the clamp plate 200 and extends through the clamp plate 200 between the two semi-circular formations and through the wall of the adjacent part of the body 210. The clamp bolt 218 extends through the cam hole 216 such that the bolt head 220 abuts the outer wall of the clamp plate 200 and the bolt end 222 extends beyond the outer wall of the body 210. A recess 224 is provided in the outer wall of the clamp plate 200 into which the bolt head 220 may be securely seated.

A cam lever 230 made from extruded aluminium is pivotally attached to the outer wall of the body 210 to enable the lever 230 to be moved between a locked and an unlocked state. The bolt end 222 is connected to the cam lever 230 such that movement of the lever 230 urges the bolt head 220 toward or away from the body 210. Pivoting the cam lever 230 toward the body 210 urges the bolt head 220 and, hence, clamp plate 200 toward the body 210 thereby reducing the diameter of the cylinders 38 and locking the tubes 23 in place. Pivoting the cam lever 230 away from the body 210 releases the bolt 218 and urges it away from the body 210 thereby releasing the tubes 23 from the locked position and permitting them to be moved relative to the adjustment means 9.

The outer wall of the body 210 is shaped and configured such that it conforms to the adjacent surface of the cam lever when pivoted toward the body 210 thereby permitting the cam lever 230 to be securely seated against the body 210 when in a locked position.

Two closed ended cylinders 240 made from moulded plastics material are pivotally attached to opposite sides respectively of the adjustment means 9. Each cylinder 240 receives an end of a tubular leg 242 made from powder coated stainless steel. The tubular legs 242 extend away from the adjustment means 9 a distance substantially equal to the other legs 40 of the base 7. The tubular legs 242 are connected at their other end by a common foot which serves to stabilise the ironing board in a deployed free standing state. A retainer 244 is pivotally attached to each adjacent leg 40 of the base 7 to limit movement of the pivoting legs 242. Each retainer 244 forms a loop around pivot pins 246 that extend through adjacent pivoting legs 244. The loops of the retainers 244 permit the pivot pins 246 to slide along a substantially linear path so that the pivoting legs 242 can be moved between extended and deployed states whilst restricting movement of the legs 242 to a maximum displacement away from the other pair of legs 40 of the base 7.

In all other aspects, the second embodiment is substantially equal in construction and method of operation as the first described embodiment.

It is of course to be understood that the above embodiments have been described by way of example only and that many variations are possible without departing from the scope of the invention.

The invention claimed is:

1. An ironing board comprising a board member, a support structure connected to the board member, and a first leg and a second leg which is pivoted relative to the first leg, the two legs forming a freestanding base, and an adjustment mechanism is provided which permits the position of the support structure relative to the base to be adjusted to enable the height of the board member to be adjusted relative to the base, wherein the board member is movable away from the base when the ironing board is in a deployed state.

2. An ironing board as claimed in claim 1, wherein the adjustment mechanism comprises a slidable connection between the support structure and the base.

3. An ironing board as claimed in claim 1, wherein the board member is pivotally attached to the support structure.

4. An ironing board as claimed in claim 1, wherein one or both legs are connected to the adjustment mechanism.

5. An ironing board as claimed in claim 1, wherein the support structure comprises a part of a leg of the board, the other part of the leg forming part of the base.

6. An ironing board comprising a board member, a support structure and a base which is remote from the board member and connected to the board member by the support structure, the base comprises a first leg and a second leg which is pivotally attached to the first leg and the support structure, the ironing board further comprises an adjustment mechanism which permits the position of the support structure relative to the base to be adjusted to enable the height of the board member to be adjusted relative to a supporting surface, wherein the first leg has an adjustable length and is pivotally connected to the board member, the ironing board further comprising a strut for attachment between the first leg and the board member thereby to support the board member.

7. An ironing board as claimed in claim 6, wherein the strut is pivotally connected to the first leg.

8. An ironing board as claimed in claim 7, wherein the strut is also pivotally and slidably connected to the board member.

9. An ironing board as claimed in claim 1, wherein the adjustment mechanism comprises an engagement mechanism to lock the position of the support structure relative to the base.

10. An ironing board as claimed in claim 1, wherein the board member is attached to the support structure.

11. An ironing board as claimed in claim 1, wherein the base is collapsible.

12. An ironing board as claimed in claim 1, wherein the support structure further comprises a strut pivotally attached to the remainder of the support structure, and the strut and remainder together support the board member.

* * * * *